US007188629B2

(12) United States Patent
Mehes et al.

(10) Patent No.: US 7,188,629 B2
(45) Date of Patent: Mar. 13, 2007

(54) ORAL HYGIENE PRODUCTS DISPENSER STAND AND DISPENSING STATION

(75) Inventors: Paul L. Mehes, Novelty, OH (US); Daniel H. Bloom, Dana Point, CA (US); Eric S. Lawrence, Moreland Hills, OH (US); Michael F. DuBois, Orange Village, OH (US)

(73) Assignee: Novelty Innovations, L.L.C., Mayfield Heights, OH (US)

( * ) Notice: Subject to any disclaimer, the term of this patent is extended or adjusted under 35 U.S.C. 154(b) by 0 days.

(21) Appl. No.: 11/164,191

(22) Filed: Nov. 14, 2005

(65) Prior Publication Data

US 2006/0048791 A1 Mar. 9, 2006

Related U.S. Application Data

(63) Continuation-in-part of application No. 10/908,314, filed on May 6, 2005, now abandoned.

(60) Provisional application No. 60/589,120, filed on Jul. 19, 2004.

(51) Int. Cl.

| | |
|---|---|
| ***A45D 44/18*** | (2006.01) |
| ***A45D 29/087*** | (2006.01) |
| ***B65D 81/24*** | (2006.01) |
| ***A61L 9/10*** | (2006.01) |

(52) U.S. Cl. ..... 132/310; 211/119.009; 206/209.1; 422/300

(58) Field of Classification Search ..... 132/310; 15/248.1; 211/70.1, 74, 119.009; 248/111, 248/152, 176.1; 422/300, 302; D6/516, D6/524, 525, 528–531

See application file for complete search history.

(56) References Cited

U.S. PATENT DOCUMENTS

| | | | |
|---|---|---|---|
| 1,226,231 | A | 5/1917 | Mack |
| 1,278,789 | A | 9/1918 | Thompson |
| 1,419,593 | A | 8/1922 | Thompson |
| 1,424,434 | A | 8/1922 | Ausubel |
| 1,556,148 | A | 2/1925 | Knott |
| 1,987,472 | A | 1/1935 | Feldon |
| 4,121,600 | A | 10/1978 | Riddick et al. |
| 4,759,383 | A | 7/1988 | Phillips |
| 4,915,219 | A | 4/1990 | Ottimo |
| 4,995,509 | A | 2/1991 | Kornfeind |
| 5,215,193 | A | 6/1993 | Dennis |
| 5,277,332 | A | 1/1994 | Rogers |
| 5,638,840 | A | 6/1997 | Lee et al. |
| 5,713,492 | A | 2/1998 | DeGennaro |
| 6,866,166 | B2 | 3/2005 | Mehes et al. |
| 2003/0178444 | A1 | 9/2003 | Brusowankin et al. |

*Primary Examiner*—Todd E. Manahan
(74) *Attorney, Agent, or Firm*—Rankin, Hill, Porter & Clark LLP

(57) ABSTRACT

An oral hygiene products dispenser stand for storing and dispensing oral hygiene products such as toothbrushes, mouthwash, disposable cups, and dental floss is described. The stand includes a base, a supporting framework for storing and dispensing disposable cups, and a plurality of toothbrush holders. The brush head end of a toothbrush can be placed into a toothbrush holder to be sanitized and dried. The stand serves as an oral hygiene products dispensing station when the base supports a bottle of mouthwash, fluoride rinse or other antiseptic fluid.

25 Claims, 7 Drawing Sheets

ORAL HYGIENE PRODUCTS DISPENSER STAND AND DISPENSING STATION

CROSS-REFERENCE TO RELATED APPLICATION

This application is a continuation-in-part of application Ser. No. 10/908,314, filed May 6, 2005, now abandoned.

BACKGROUND OF THE INVENTION

1. Field of Invention

The present invention relates to an oral hygiene products dispenser stand and, more particularly, to an oral hygiene products dispenser stand for dispensing mouthwash and disposable cups and for sanitizing and storing toothbrushes.

2. Description of Related Art

It is well known that a daily oral hygiene routine that includes the use of a sanitary toothbrush, toothpaste, dental floss and mouthwash should be consistently practiced in order to prevent the onset of tooth decay, gum disease and other undesirable oral and dental conditions. However, many people fail to consistently practice a thorough and proper daily oral hygiene routine despite having such knowledge. It is believed that the inconvenient location of the various products and devices needed to practice a proper oral hygiene routine may be a major contributing factor to this problem.

In a typical household bathroom, toothbrushes may be stored in a holder, such as a drinking glass, which is placed on or near a countertop adjacent to a sink. Toothpaste and dental floss may be stored in a different location, such as in a medicine cabinet or drawer. Mouthwash and/or fluoride rinses may be stored in yet another location, such as in a closet or cabinet. Disposable cups, if they are present at all, may be stored in a dispenser that is mounted to a wall at a location other than where the toothbrushes are stored. Thus, the various essential products and devices that must be utilized in order to practice a thorough and proper daily oral hygiene routine are typically scattered throughout the bathroom and some may simply be "out of sight and out of mind."

The improper storage and sanitation of oral hygiene products and devices can give rise to health concerns. Toothbrushes, in particular, can harbor disease-causing bacteria and germs if not properly sanitized and stored. While consumers are often advised to begin using a new toothbrush at least every three months, they are generally not informed that proper toothbrush sanitation can reduce the spread of household germs and illnesses. There is a need for a convenient and safe method of sanitizing a toothbrush that will help prevent the spread of household germs.

Some equipment for organizing and dispensing oral hygiene products is known in the art. For example, U.S. Pat. No. 5,215,193 to Dennis discloses a dental storage apparatus that includes a container for mouthwash, a cup dispenser and various compartments for oral hygiene products such as toothpaste, floss, and toothbrushes. Similarly, U.S. Pat. No. 4,121,600 to Riddick et al. discloses an oral hygiene dispenser including a compartment for a mouthwash bottle, a disposable cup dispenser, and gripping elements for holding toothbrushes. While the general concept of organizing oral hygiene products in a single location is known in the art, there exists a need for an improved apparatus for organizing oral hygiene products. Additionally, there exists a need for such an apparatus that also provides for an effective and convenient method of sanitizing toothbrushes.

BRIEF SUMMARY OF THE INVENTION

In view of the foregoing, the present invention is directed toward an improved oral hygiene products dispenser stands. Oral hygiene products dispenser stands of the present invention are designed to serve as convenient central storage and dispensing stations for oral hygiene products such as toothbrushes, mouthwash, disposable cups, and dental floss, which are essential for practicing a thorough and proper daily oral and dental hygiene routine. In addition to serving as convenient central storage locations for dental and oral hygiene products, oral hygiene products dispenser stands according to the invention also sanitizes toothbrushes to prevent or retard the growth of bacteria and the spread of germs.

In a first preferred embodiment of the invention, an oral hygiene products dispenser stand comprises a base, a truss connected to and extending upwardly from the base, and a shelf connected to and supported by the truss. A disposable cup dispenser is attached to the shelf. Dental floss can be stored and dispensed from the top of the disposable cup dispenser. A bottle of antiseptic fluid such as mouthwash, fluoride rinse or other oral sanitizing solution can be placed on the base through an opening formed in the shelf. At least one and more preferably a plurality of toothbrush holders are supported by the shelf. Each toothbrush holder comprises a hollow receptacle having an open upper end through which the brush head end of a toothbrush can pass, a closed lower end, and a partition disposed between the open upper end and the closed lower end. The partition divides the hollow receptacle into a lower compartment defined as that portion of the receptacle from the closed lower end to the partition and an upper compartment defined as that portion of the receptacle from the partition to the open upper end. The partition prevents the brush head end of a toothbrush from entering the lower compartment. In addition, the partition includes a drain system for allowing an antiseptic fluid to flow from the upper compartment to the lower compartment through the partition at a rate of from about 0.05 ounces per minute to about 2 ounces per minute. Thus, the brush head end of the toothbrush can be submerged in antiseptic fluid for a period of time sufficient to properly sanitize the brush head end of the toothbrush, and can be permitted to air dry prior to the next use. The top of a mouthwash bottle resting on the base preferably extends through the opening formed in the shelf. The mouthwash bottle preferably includes a child-safe dispensing pump closure that facilitates the convenient dispensing of a predetermined amount of mouthwash into a disposable cup, which may be obtained from the cup dispenser. This embodiment of an oral hygiene products dispenser stand according to the invention is preferably made of a plastic material, and can either simply rest on a countertop or be attached to a wall. When coupled with a bottle of antiseptic fluid, the oral hygiene products dispenser stand according to this embodiment of the invention provides a convenient and compact oral hygiene products dispensing station.

In a second embodiment of the invention, an oral hygiene products dispenser stand comprises a base structure comprising a perimeter wire member and a plurality of wire lattice members having ends connected to the perimeter wire member to form a generally planar support for a bottle. At least one side panel is connected to the base structure. The side panel comprises an upright that supports a shelf structure provided with at least one passage. A detachable toothbrush holder configured to partially pass through the passage and is supported by the shelf structure. A cup holding structure is connected to the base structure. The cup holding structure comprising a plurality of columns define a receptacle for receiving a stack of disposable cups. The second embodiment of the invention is preferably formed of metal wire, but can be formed of plastic or other materials.

In a third embodiment of the invention, an oral hygiene products dispenser stand comprises a base structure for supporting a bottle of antiseptic fluid, a plurality of uprights extending upwardly from the base structure and at least one side panel that connects to the uprights to define a corral for holding the bottle of antiseptic fluid. A shelf structure is connected to and supported by the uprights. A pair of detachable toothbrush holders are supported by passages supported by the shelf structure. A disposable cup dispenser is disposed adjacent to the base structure, and is preferably connected to the side panel.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
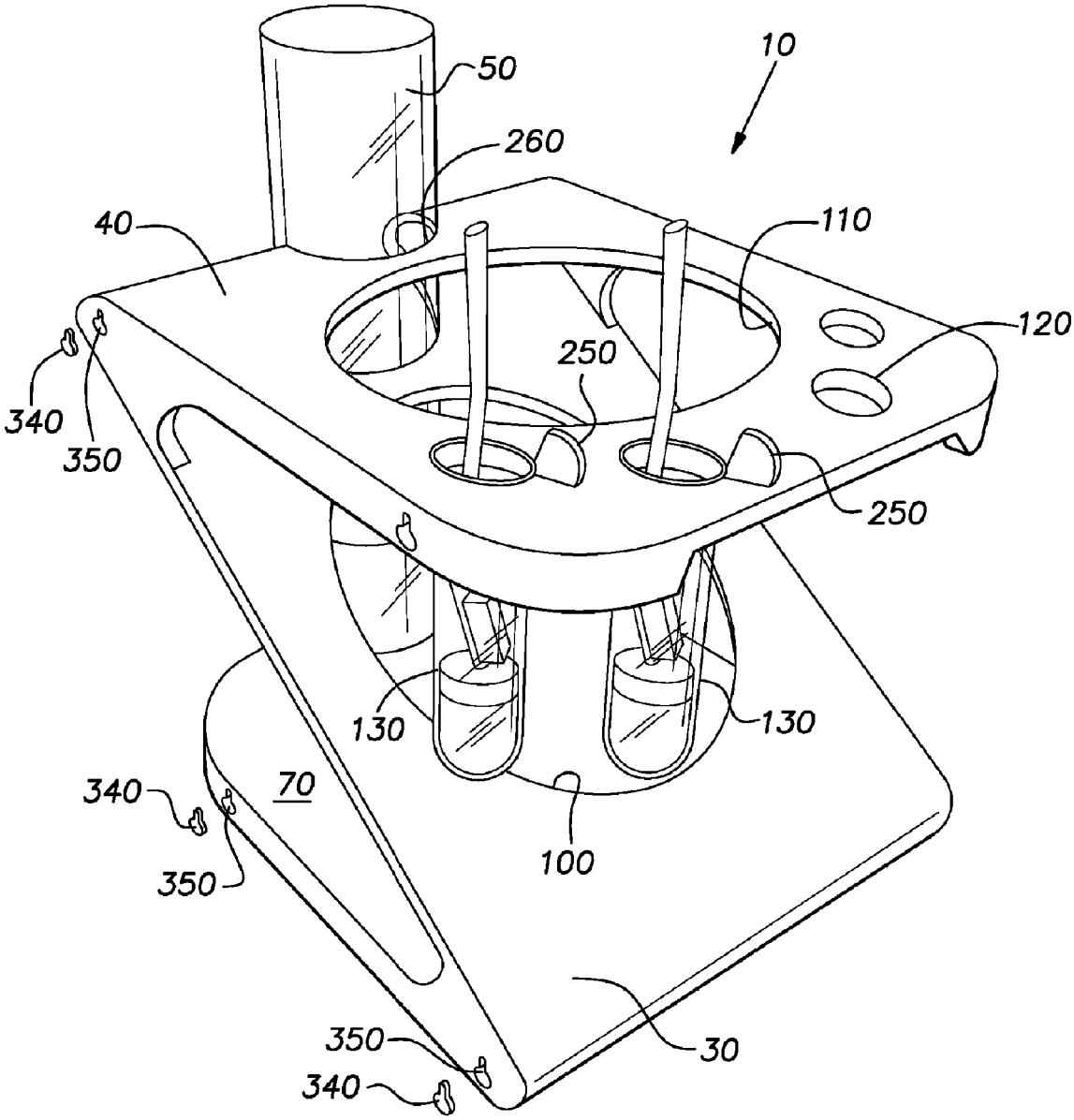
FIG. 1 is a perspective view of a first preferred embodiment of an oral hygiene products dispenser stand according to the present invention.
Figure 2:
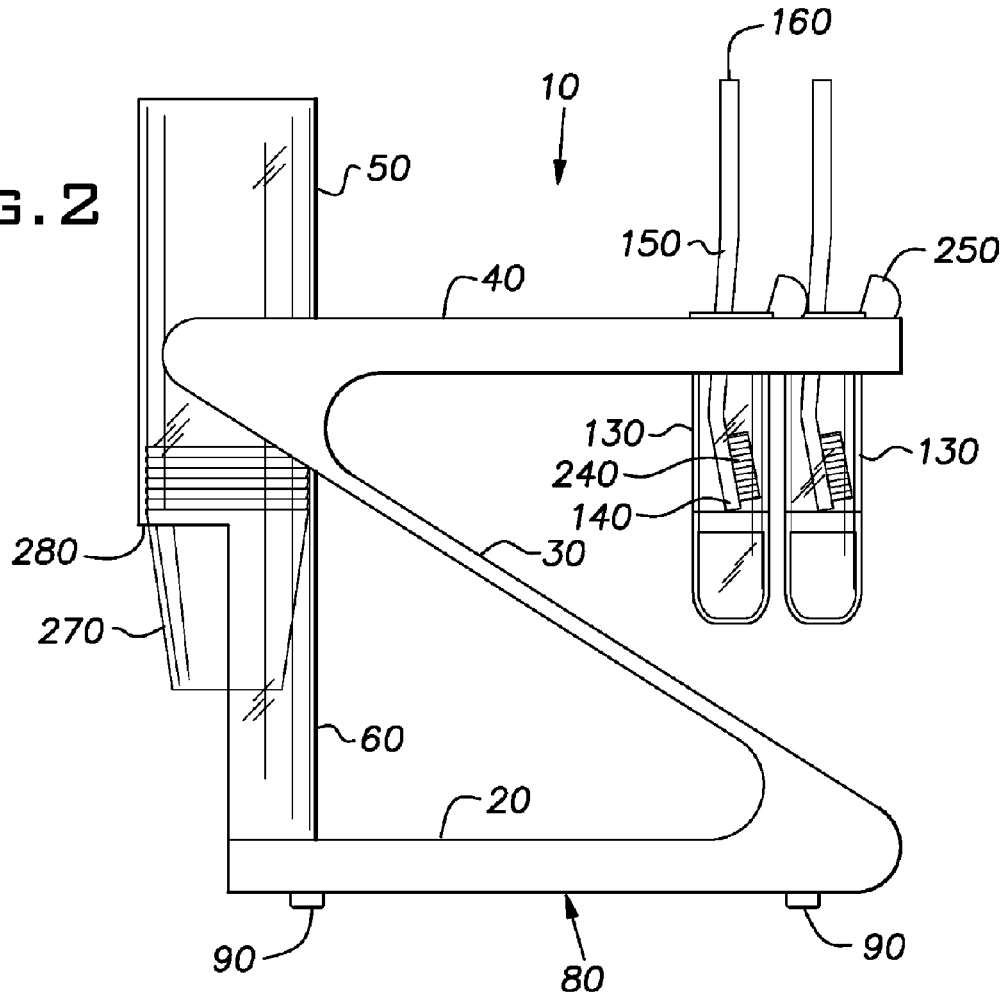
FIG. 2 is a side plan view of the oral hygiene products dispenser stand shown in FIG. 1.

FIGS. 1 and 2 show views of an oral hygiene products dispensing stand 10 according to a first embodiment of the invention. The stand 10 comprises a base 20, a truss 30 that is connected to and extends upwardly from the base 20, and a shelf 40 that is connected to the truss 30. A disposable cup dispenser 50 is attached to the shelf 40. In the configuration of the invention shown in FIGS. 1 and 2, the disposable cup dispenser 50 includes a tail portion 60 that extends downwardly to the base 20 to provide additional support for the shelf 40.

The base 20 is preferably planar and has a top surface 70 and a bottom surface 80. It will be appreciated that the base 20 may be shaped in any manner that is suitable for supporting a bottle. Preferably, the top surface 70 of the base 20 is shaped to support the bottle in an upright orientation. To this end, the top surface 70 of the base 20 may be provided with a rim and/or a depression (not shown) that cradles the bottle and supports it in an upright position.

The bottom surface 80 of the base 20 may include one or more feet 90, as shown in FIG. 2. The feet 90 preferably prevent the stand 10 from sliding on a smooth surface such as a countertop. It will be appreciated that other types of attachment means such as suction cups or VELCRO-type hook and loop fasteners, for example, can also be used.

The function of the truss 30 is to suspend the shelf 40 above the base 20. Thus, the configuration of the truss 30 is not per se critical. In the configuration of the invention shown in FIGS. 1 and 2, the truss 30 is a substantially planar member that is positioned at an angle relative to both the shelf 40 and the base 20 so that the base 20, truss 30 and shelf 40 together define the shape of a "Z" (or reverse "Z", depending upon the side being viewed). The truss 30 is preferably provided with an opening 100 that is of sufficient size to allow for the passage of a bottle that is placed on the base 20. In the embodiment illustrated in FIGS. 1 and 2, the truss 30 is a solid sheet having a circular or rounded opening 100. It will be appreciated that the shape of the opening 100 in the truss is largely a matter of aesthetic design choice, and that a variety of shapes and sizes can be used.

Figure 4:
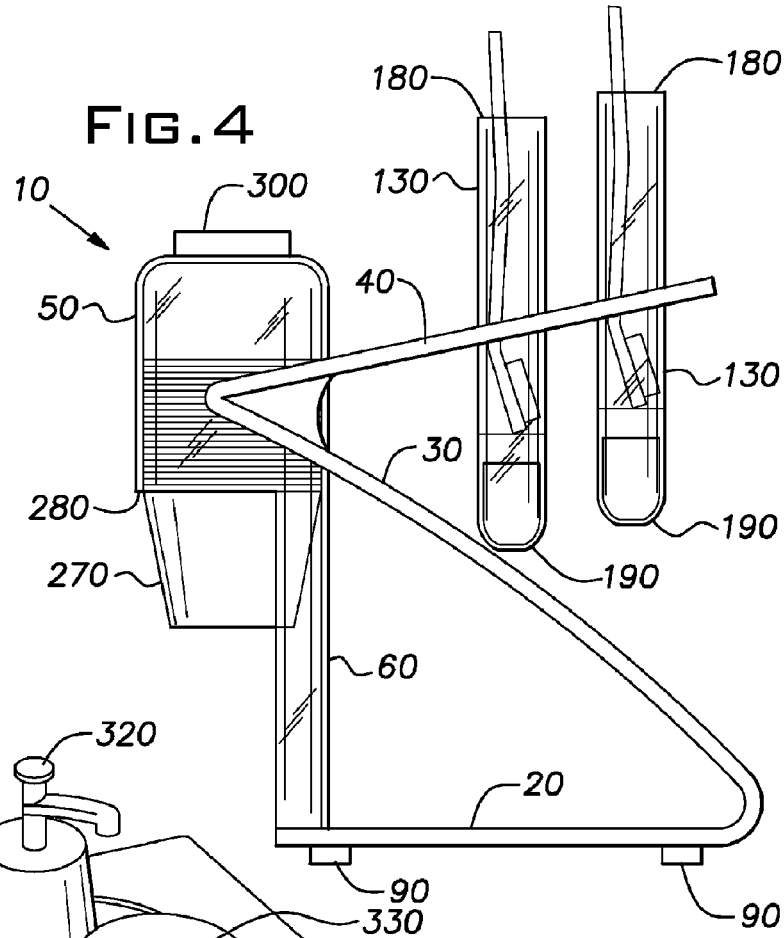
FIG. 4 is a side plan view of an alternative configuration of the first preferred embodiment of an oral hygiene products dispenser stand according to the invention.

The base 20 and the shelf 40 may be substantially parallel to each other as shown in FIG. 2, or the base 20 and the shelf 40 may not be parallel to each other (e.g., see FIG. 4). The base 20 and shelf 40 are preferably aligned such that the shelf 40 is generally positioned above the base 20. Preferably, the base 20 and the shelf 40 have approximately the same dimensions, as illustrated in FIG. 2.

The shelf 40 is also provided with an opening 110 that is large enough to allow for the passage of a bottle of antiseptic fluid such as mouthwash or fluoride rinse through the shelf 40 to the base 20. The shape of the opening 110 is not critical. The opening 110 in the shelf 40 shown in FIG. 1 is circular, but other shapes could be used.

The bottom of the bottle rests upon a top surface 70 of the base 20 and the top of the bottle preferably extends through the opening 110 formed in the shelf 40. The middle of the bottle is preferably disposed in the opening 100 formed in the truss 30 or between opposing truss members (not shown).

In the embodiment of the invention shown in FIGS. 1 and 2, four passages 120 are formed in the shelf 40. It will be appreciated that one or a plurality of passages 120 can be formed in the shelf 40 without departing from the invention. Each passage 120 receives a toothbrush holder 130. Each toothbrush holder 130 is sized to receive the brush head end 140 of a toothbrush 150, leaving at least a portion of the handle end 160 of the toothbrush 150 exposed.

The passages 120 may be formed in any desired location on the shelf 40. Preferably, the passages 120 are formed along a peripheral edge of the shelf 40 opposite the connection point to the truss 30 so that the toothbrush holders 130 do not contact the truss 30. However, because of the preferred "Z-shaped" configuration of the stand 10 and the angle of the truss 30, in alternate versions of this embodiment, passages could also be formed within the truss 30 to allow the lower portion of the toothbrush holders 130 to pass therethrough.

Figure 3A:
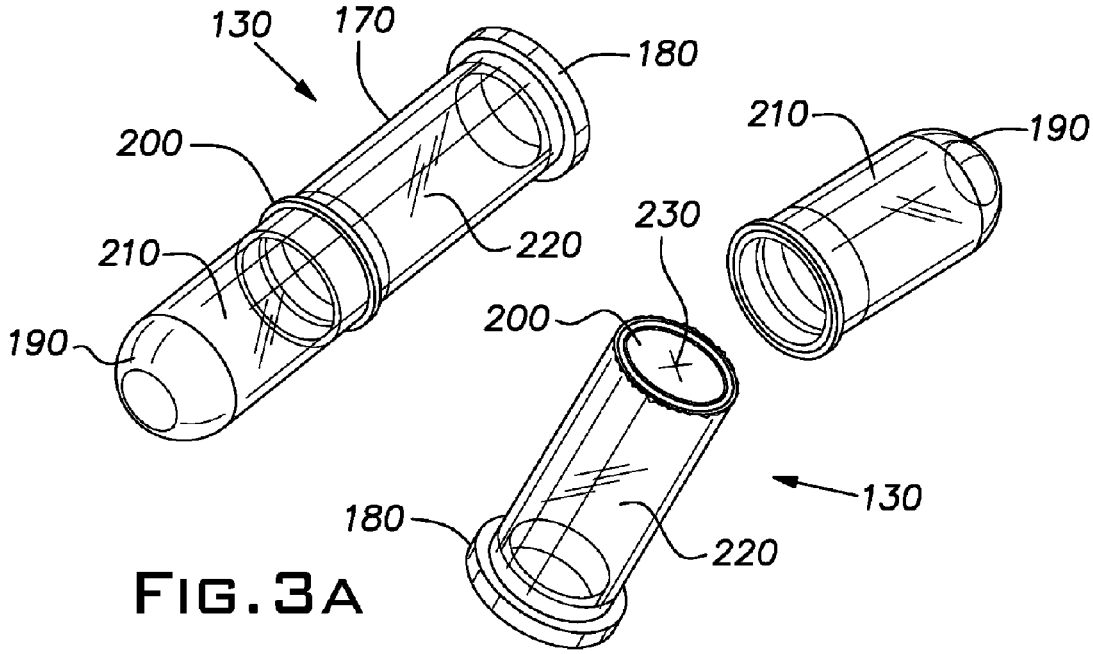
FIG. 3*a* shows perspective views of an exemplary toothbrush holder according to the invention in an assembled state and in a disassembled state, respectively.

With reference to FIG. 3*a*, each toothbrush holder 130 comprises a hollow receptacle 170 having an open upper end 180 through which the brush head end 140 of a toothbrush 150 can pass, a closed lower end 190, and a partition 200 disposed between the open upper end 180 and the closed lower end 190. The individual toothbrush holders 130 can be made of different substantially transparent colored plastics so that individual users can identify their respective toothbrush holder 130. More preferably, the entire toothbrush holder 130 is made of clear, transparent plastic, but the upper end 180 of each the toothbrush holder 130 is provided with a colored band, which allows individual users to identify their particular toothbrush holder 130.

The partition 200 divides the hollow receptacle 170 into a lower compartment 210 defined as that portion of the hollow receptacle 170 from the closed lower end 190 to the partition 200, and an upper compartment 220 defined as that portion of the hollow receptacle 170 from the partition 200 to the open upper end 180. The upper compartment 220 must be large enough to receive the brush head end of a toothbrush and thus may be larger than, the same diameter as, or smaller than the lower compartment 210. The upper compartment may be sized to receive detachable brush heads for electric and/or sonic mechanical toothbrushes.

The partition 200 supports the brush head end 140 of the toothbrush 150 and prevents it from entering the lower compartment 210. The partition 200 also includes at least one drain 230 that allows antiseptic fluid to flow from the upper compartment 220 to the lower compartment 210 through the partition 200 at a rate of from about 2 to about 6 ml per minute, or more preferably from about 3 to about 4 ml per minute, meaning that approximately 30 ml (approximately 1 fluid ounce) or so of antiseptic fluid can drain through the drain in about 5 to about 15 minutes, or more preferably in about 8 to about 10 minutes.

In the embodiment illustrated in FIG. 3*a*, the lower compartment 210 is releasably attached to the upper compartment 220. A variety of suitable attachment means can be used for this purpose. For example, the lower compartment 210 may be provided with threads that engage with threads formed on the upper compartment 220, allowing the two parts to be separated by a twisting motion (e.g., threaded to separate with a ¼ turn). Alternatively, the lower compartment 210 may comprise a resilient collar that makes a friction-fit onto the upper compartment 220. Thus, when the lower compartment 210 fills with antiseptic fluid drained from the upper compartment 220, the lower compartment 210 may be separated and removed from the upper compartment 220 to be emptied and then reattached. Both the upper compartment 220 and the lower compartment 210 are preferably formed of a synthetic polymer material (e.g., polyethylene or polycarbonate), which is preferably dishwasher safe.

Figure 3B:
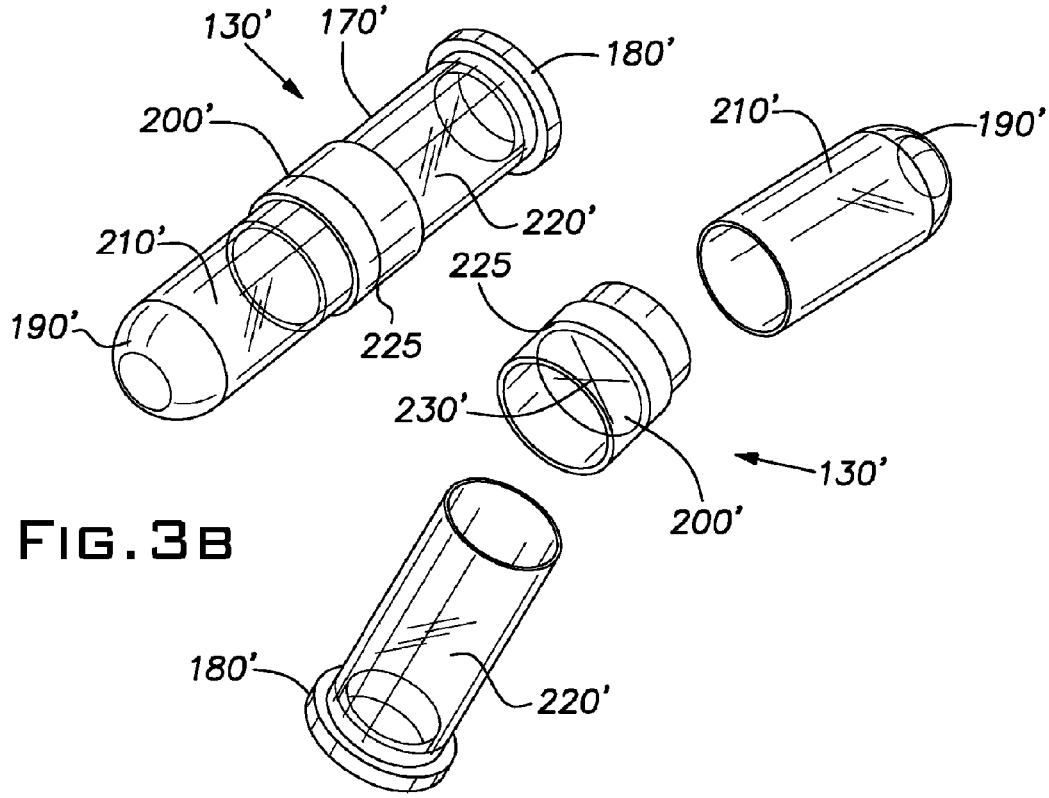
FIG. 3*b* shows perspective views of another exemplary toothbrush holder according to the invention in an assembled state and in a disassembled state, respectively.

FIG. 3*b* shows a preferred alternative embodiment of toothbrush holders 130' according to the invention. The toothbrush holders 130' comprises a hollow receptacle 170' having an open upper end 180' through which the brush head end of a toothbrush can pass, a closed lower end 190', and a partition 200' disposed between the open upper end 180' and the closed lower end 190'. The partition 200' divides the hollow receptacle 170' into a lower compartment 210' defined as that portion of the hollow receptacle 170' from the closed lower end 190' to the partition 200', and an upper compartment 220' defined as that portion of the hollow receptacle 170' from the partition 200' to the open upper end 180'. In the embodiment of the invention shown in FIG. 3*b*, the partition 200' is formed in a disposable filter component 225, which is not integrally formed with the lower compartment 210' or the upper compartment 220'. The upper compartment 220' and the lower compartment 210' releasably engage with and attach to opposite sides of the disposable filter component 225. Threaded engagement means and/or resilient friction collar means may be used to releasably secure the lower compartment 210' and the upper compartment 220' to the disposable filter component 225.

The partition 200' includes a drain 230' that allows antiseptic fluid to flow from the upper compartment 220' to the lower compartment 210' through the partition 200' at a rate of from about 2 to about 6 ml per minute, or more preferably from about 3 to about 4 ml per minute, meaning that approximately 30 ml (approximately 1 fluid ounce) or so of antiseptic fluid can drain through the drain in about 5 to about 15 minutes, or more preferably in about 8 to about 10 minutes. The disposable filter component 225 can be discarded and replaced with a new disposable filter component 225 periodically, or if the drain 230' should become clogged. The disposable filter component 225 is preferably made of a synthetic polymeric material (e.g., polyethylene or polycarbonate), which is preferably dishwasher safe.

Figure 3C:
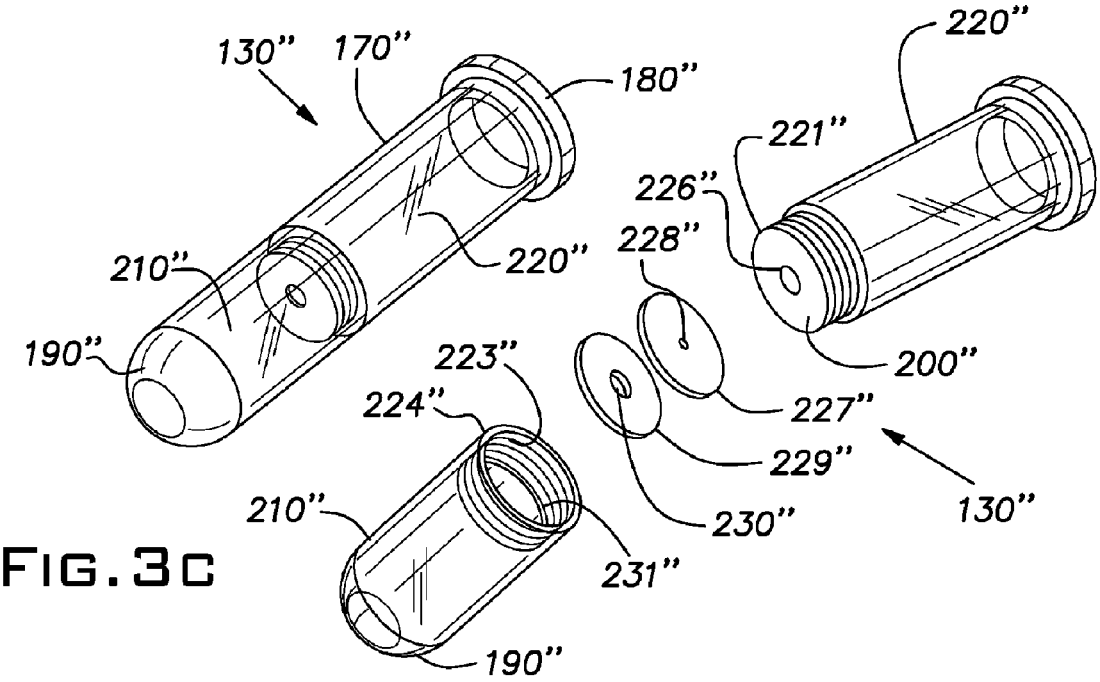
FIG. 3*c* shows perspective views of another exemplary toothbrush holder according to the invention in an assembled state and in a disassembled state, respectively.

FIG. 3*c* shows yet another preferred alternative embodiment of toothbrush holders 130" according to the invention. The toothbrush holders 130" comprises a hollow receptacle 170" having an open upper end 180" through which the brush head end of a toothbrush can pass, a closed lower end 190", and a partition 200" disposed between the open upper end 180' and the closed lower end 190'. The partition 200" divides the hollow receptacle 170" into a lower compartment 210" defined as that portion of the hollow receptacle 170" from the closed lower end 190" to the partition 200", and an upper compartment 220" defined as that portion of the hollow receptacle 170" from the partition 200" to the open upper end 180".

In the embodiment of the invention shown in FIG. 3*c*, the partition 200" is formed integrally at the lower end 221" of the upper compartment 220". Threads 222" on the lower end 221" of the upper compartment engage with threads 223" on the upper end 224" of the lower compartment 210" to join the upper compartment 220" to the lower compartment 210". It will be appreciated that resilient friction collar means may be used to releasably secure the lower compartment 210" to the upper compartment 220". An opening 226" is provided through the partition 200". A disposable filter disk 227" having an opening 228" that is smaller than the opening 226" through the partition 200" is held against the lower end 221" of the upper compartment 220" by a cap 229", which is also provided with an opening 230" that is larger than the opening 228" in the disposable filter disk 227". The cap 229" snaps onto or otherwise engages with the lower end 221" of the upper compartment 220" to trap and secure the filter disk 227" in contact with the lower end 221" of the upper compartment 220". Preferably, the upper end 224" of the lower compartment 210" includes a rim portion 231" that presses against the cap 229" when the upper compartment 220" and lower compartment 210" are coupled together. The opening 228" in the filter disk 227" aligns with the opening 226" through the partition 200" and the opening 230" in the cap 229", and defines the rate at which anti-septic fluid passes from the upper compartment 220" to the lower compartment 210".

The opening 228" through the filter disk preferably allows antiseptic fluid to flow from the upper compartment 220" to the lower compartment 210" at a rate of from about 2 to about 6 ml per minute, or more preferably from about 3 to about 4 ml per minute, meaning that approximately 30 ml (approximately 1 fluid ounce) or so of antiseptic fluid can drain through the drain in about 5 to about 15 minutes, or more preferably in about 8 to about 10 minutes. If and when the rate of the flow of anti-septic fluid from the upper compartment 220" to the lower compartment 210" becomes unacceptably low due to clogging or obstruction of the opening 228" through the filter disk 227", the filter disk 227" can be removed and replaced with a new filter disk 227".

It will be appreciated that two or more upper compartments 220, 220', 220" can share and thus be fluidly connected to the same lower compartment 210, 210', 210". The lower compartment 210, 210', 210" can span the gap between adjacent upper compartments 220, 220', 220", or can be connected to such upper compartments 220, 220', 220" using flexible tubing. Thus, a single large capacity reservoir can be used to collect the antiseptic fluid that drains from a plurality of upper compartments.

To sanitize a toothbrush 150, a user simply inserts the brush head end 140 of the toothbrush 150 into the toothbrush holder through the open upper end until the brush head end 140 contacts the partition. The bristles 240 of the toothbrush 150 are thus immersed in an antiseptic fluid such as mouthwash, which may be introduced into the upper compartment before or after the brush head end 140 of the toothbrush 150 is inserted into the toothbrush holder. The antiseptic fluid contacts and thereby sanitizes the brush head end 140 of the toothbrush 150, killing any bacteria and/or germ material that may be trapped or concealed within the bristles 240. The antiseptic fluid flows from the upper compartment to the lower compartment through the drain. After the antiseptic fluid has drained from the upper compartment, the bristles 240 of the toothbrush 150 are able to air dry.

In the embodiment of the invention shown in FIGS. 1 and 2, each toothbrush holder 130 is provided with a lift tab 250 that extends outwardly from the toothbrush holder 130 adjacent to the open upper end 180. The lift tab 250, which may be of any shape, provides a gripping surface that allows a user to withdraw a toothbrush holder 130 from the passage 120 in the shelf 40. The lift tab 250 also prevents the toothbrush holder 130 from passing completely through the passage 120. The lift tab 250 thus acts as a stop when it makes contact with the shelf 40.

In the version of the first embodiment of the invention shown in FIG. 4, the toothbrush holders 130 do not include a lift tab 250. In such embodiment, the diameter of each toothbrush holder 130 is slightly larger near the upper open end 180 than the diameter of the toothbrush holder 130 near the lower closed end 190. The passages 120 are sized to permit passage of the lower closed end 190, but not the upper open end 180. Thus, the toothbrush holders 130 are retained in the passages 120 at or near the midpoint of the toothbrush holders 130. Because a substantial portion of each toothbrush holder 130 extends above and below the shelf 40, there is no need for a lift tab 250 to remove the toothbrush holder 130 from the shelf 40 in this embodiment.

The disposable cup dispenser 50 is attached to the shelf 40, preferably in a notch 260 formed in the shelf 40. In the configurations of the invention illustrated in FIGS. 2 and 4, the disposable cup dispenser 50 includes a tail portion 60 that extends downwardly and contacts the base 20. The tail portion 60 preferably terminates in a tooth that is received in a groove or opening formed in the base 20. The tooth and groove preferably have a snap-fit engagement, which assists in securing the disposable cup dispenser 50 to the stand 10. Once connected to the base 20, the tail portion 60 provides support to the disposable cup dispenser 50 and prevents lateral motion of the disposable cup dispenser 50 relative to the shelf 40 and base 20. While a tail portion 60 is shown in the embodiments of the invention shown in FIGS. 2 and 4, alternative support means can be provided to support and prevent lateral motion of the disposable cup dispenser 50. For example, in the configuration of the invention illustrated in FIG. 5, the cup dispenser is attached to a front portion of the shelf 40, and a spar 360 is used to provide additional support between the base 20 and the shelf 40.

It will be appreciated that the disposable cup dispenser 50 can be attached to any part of the shelf 40. In the versions of the invention shown in FIGS. 2 and 4, the disposable cup dispenser 50 is attached to a rear side of the shelf 40 opposite of the front side of the shelf 40 where the toothbrush holders 130 are attached. In the version of the invention shown in FIG. 5, the disposable cup dispenser 50 is attached to the front side of the shelf 40 with the toothbrush holders 130. If desired, two or more disposable cup dispensers 50 could be attached to the shelf 40.

One or more disposable cups 270 may be inserted into the disposable cup dispenser 50. Disposable cups 270 are loaded into the disposable cup dispenser 50 by pushing one or a stack of cups 270 upwardly into a mouth 280 of the disposable cup dispenser 50, rim portion first. After the cup or stack of cups 270 have been loaded into the disposable cup dispenser 50 through the mouth 280 of the dispenser 50, a single disposable cup 270 may be selectively removed through the mouth 280 of the dispenser 50 simply by gripping and pulling the cup 270 downwardly from the dispenser 50.

Figure 5:
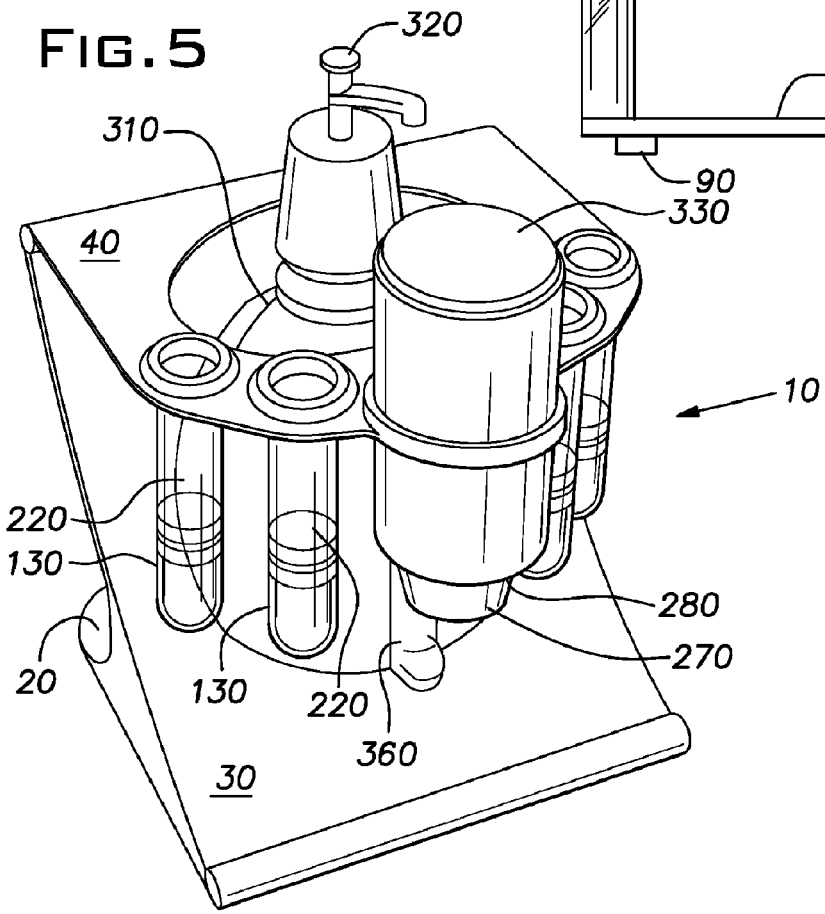
FIG. 5 is a perspective view of yet another configuration of the first preferred embodiment of an oral hygiene products dispenser stand according to the invention supporting a bottle of mouthwash.
Figure 6:
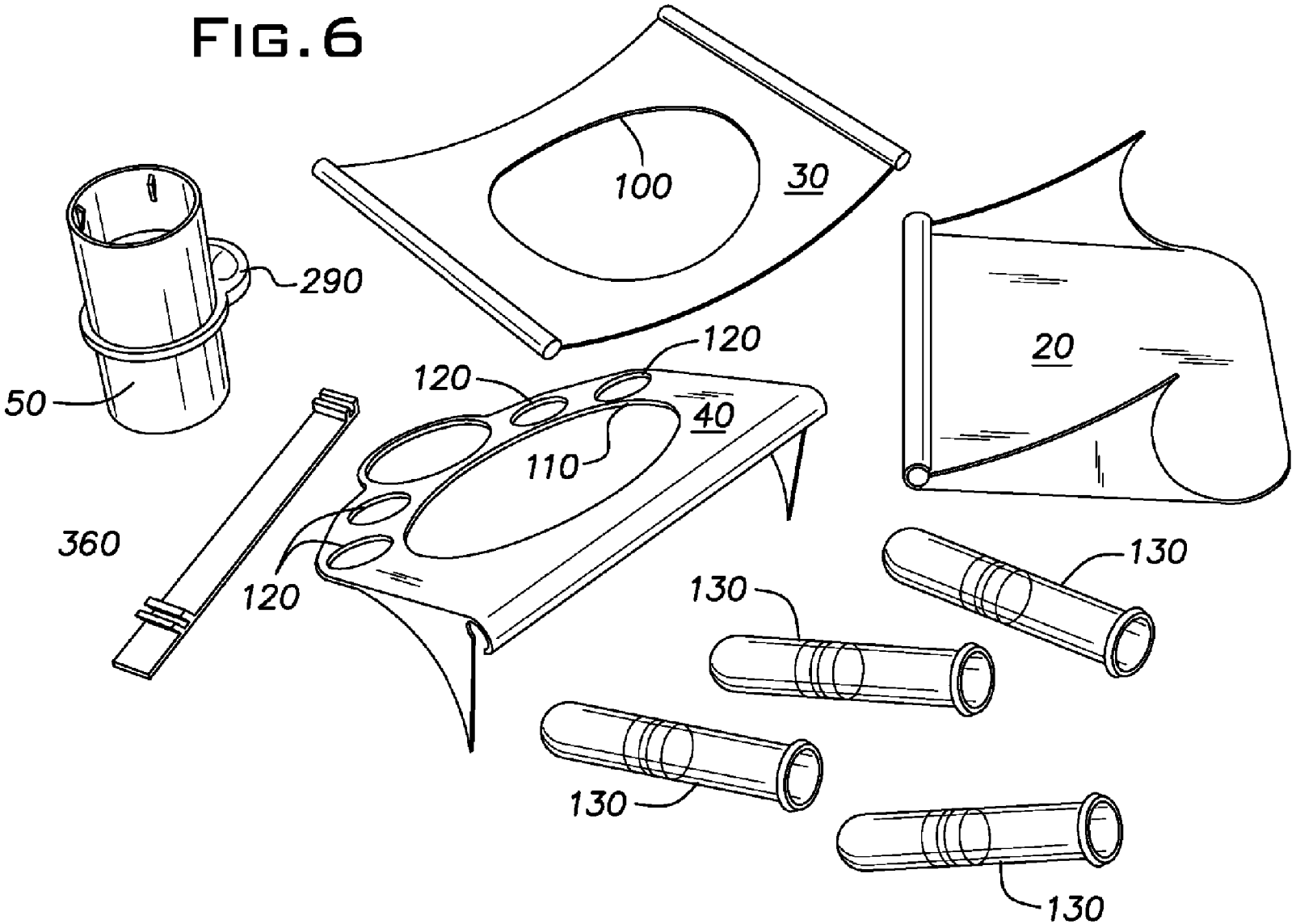
FIG. 6 is a perspective view of the disassembled oral hygiene products dispenser stand shown in FIG. 5.

Alternatively, as shown in FIG. 5, the disposable cup dispenser 50 can be provided with a lid 330 that can be removed to provide access to the interior portion of the disposable cup dispenser 50. In this embodiment, a stack of disposable cups 270 can be loaded into the disposable cup dispenser 50 from the top for dispensing through the mouth 280. FIG. 6 is a perspective view showing the individual components of the stand 10 shown in FIG. 5 in a disassembled state.

With reference to FIG. 4, a container of dental floss 300 can optionally be secured to the top of the disposable cup dispenser 50. When the container of dental floss 300 is empty, it can be removed from the top of the disposable cup dispenser 50 and replaced with a new container of dental floss 300.

In the version of the invention shown in FIG. 5, the stand 10 is configured to receive a bottle 310 containing an antiseptic fluid such as mouthwash. The bottle 310 is preferably provided with a pump 320 having a spout 330. A pump 320 allows a user to dispense antiseptic fluid such as mouthwash without lifting the bottle 310. Preferably, the pump 320 is configured to dispense a predetermined volume of antiseptic fluid from the bottle 310 that does not exceed the volume capacity of the disposable cups 270 retained in the disposable cup dispenser 50 or the upper compartment 220 of the toothbrush holders 130.

The pump 320 encourages the use of disposable cups 270, which are far more sanitary for dispensing antiseptic fluids such as mouthwash than using the cap of the bottle 310 as a cup, sharing a cup among several users, or dispensing mouthwash into one's mouth directly from the bottle itself. Preferably, the pump 320 is a child-safe pump that can be locked or otherwise secured so that small children cannot access to the contents of the bottle 310.

The pump 320 is preferably configured to pivot on a vertical axis. The toothbrush holders 130 are attached to the perimeter of the shelf 40 beneath where the spout 330 of the pump 320 as is situated as the pump 320 is pivoted. Thus, a user can pivot the pump 320 until the spout 330 is positioned over a toothbrush holder 130, and then use the pump 320 to dispense antiseptic fluid directly into the upper compartment 220 of the toothbrush holder 130 without removing the toothbrush holder 130 from the shelf 40. Alternatively, a user can lift the toothbrush holder 130 partially or completely from the opening 120, dispense the antiseptic fluid into the upper compartment 220 of the toothbrush holder 130 and reposition the toothbrush holder 130 in the opening 120.

Oral hygiene products dispensing stands 10 according to the invention are primarily intended for placement on a countertop adjacent to a sink in a bathroom. The stands 10 are aesthetically pleasing and serve as oral hygiene products dispensing stations. All of the products necessary for good oral hygiene are collected in a single location, and the products are readily available for use. It will be appreciated, however, that the stand 10 can be mounted to a wall, if desired. To facilitate optional wall mounting, the stands 10 may be provided with knockouts 340 (see FIG. 1), which may be removed from the shelf 40 and base 20 to expose mounting openings 350 for mounting the stand 10 to a wall. Nails, screws or other fasteners can be inserted at proper locations in the wall, and then the stand 10 can be suspended from the fasteners using the mounting openings 350.

The oral hygiene products dispenser stands 10 described hereinabove can be formed as a unitary, integral component using thermoplastic materials by conventional injection molding means. More preferably, however, the stands comprise several components that are assembled together to form the stands. The components can be joined together by a snap-fit arrangement using projecting fingers that engage with mating slots formed on adjoining components. Alternatively, the individual components can be joined together by providing mating beads and channels on the components such as shown in FIGS. 5 and 6. The disassembled stand can be packaged together with one or more oral hygiene products for shipment and sale.

Figure 7:
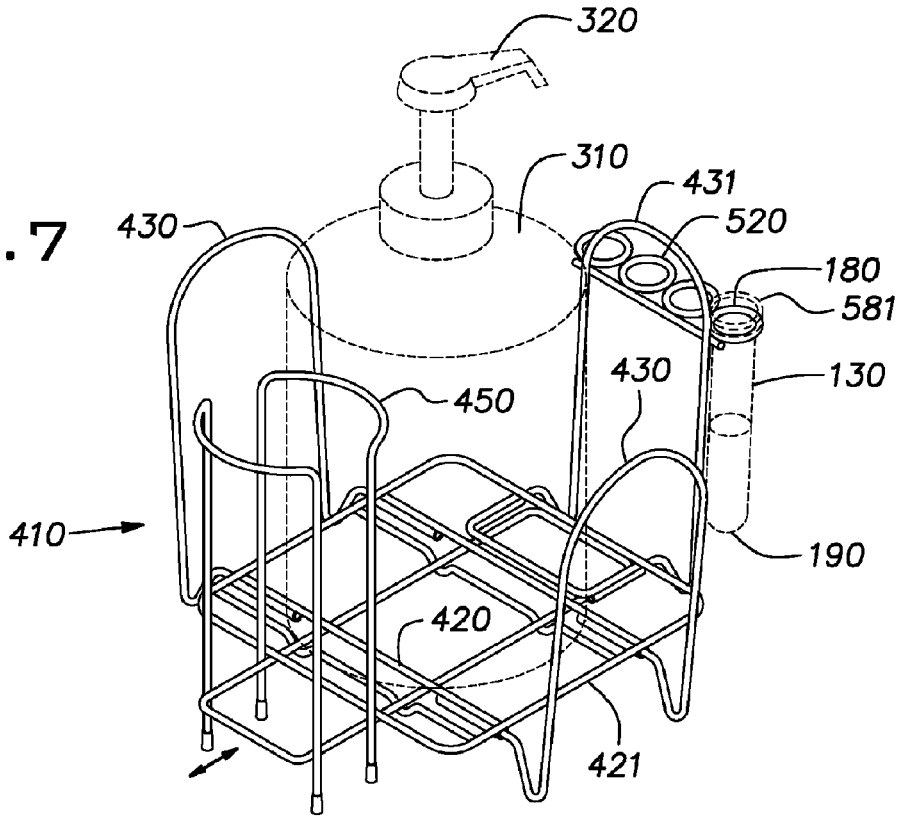
FIG. 7 is a perspective view of a second preferred embodiment of an oral hygiene products dispenser stand according to the present invention.
Figure 8:
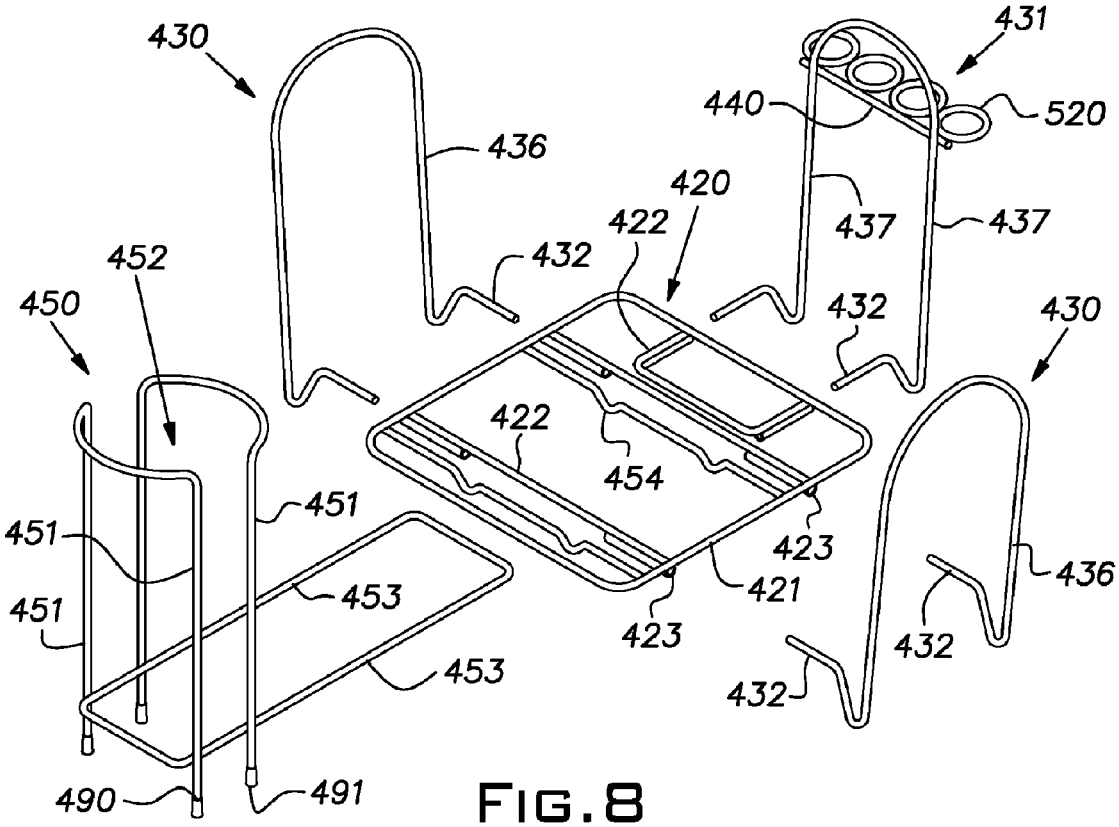
FIG. 8 is an exploded view of the oral hygiene products dispenser stand shown in FIG. 7.

A second preferred embodiment of an oral hygiene dispenser stand 410 according to the invention is shown in FIGS. 7 and 8. In this embodiment, the stand 410 is preferably formed of metal wire rather than plastic. The stand 410 comprises a base structure 420 for supporting a bottle 310 of antiseptic fluid. The base structure 420 preferably comprises a perimeter wire member 421 and a plurality of wire lattice members 422. The wire lattice members 422 are connected at each end to the perimeter wire member 421 and collectively support a bottle 310 of antiseptic fluid, which preferably includes a pump 320. Some or all of the wire lattice members 422 may span across the opening defined by the perimeter wire member 421, or they may simply extend into the opening defined by the perimeter wire member 421 but connect to the same or an adjacent side of the perimeter wire member 421.

The base structure 420 preferably further comprises a plurality of receiving tubes 423, the longitudinal axis of which are generally disposed parallel to each other in the same plane as the wire lattice members 422 and thus also serve to provide support for a bottle 310 of antiseptic fluid. The receiving tubes 423 are configured to receive the ends 432 of side panels 430, 431. Side panel 430 includes uprights 436 that serve to keep a bottle 310 of anti-septic fluid positioned on the base structure 420. Side panel 431 includes a shelf structure 440 supported by uprights 437. The shelf structure 440 includes a plurality of passages 520 for receiving and supporting a toothbrush holder 130 such as shown in FIGS. 3*a*–3*c*. The diameter of each toothbrush holder 130 can be slightly larger near the upper open end 180 than the diameter of the toothbrush holder 130 near the lower closed end 190, and the passages 520 can be sized to permit passage of the lower closed end 190, but not the upper open end 180 (e.g., as shown in FIG. 4). More preferably, however, the open end 180 of each toothbrush holder is provided with a flange 581, which is larger than the diameter of the passage 520 and thus prevents the toothbrush holder 130 from passing completely through the passage 520.

For residential applications, the stand 410 must include at least one side panel 431, but could optionally include two or three side panels 431, if desired. Such a stand 410 could include zero, one or two side panels 430 depending on the number of side panels 431 present, provided the sum of the side panels 430, 431 did not exceed three. A user can customize the stand 410 as desired by selecting and installing the side panels 430, 431 as desired.

The stand 410 also preferably comprises a cup holding structure 450, which adjustably connects to the base structure 420. The cup holding structure 450 preferably comprises a plurality of columns 451 that extend generally upwardly, substantially perpendicular to the plane of the base structure 420. The columns 451 define a receptacle 452 for receiving a stack of disposable cups 270, oriented rim portion facing down. When inserted into the receptacle defined by the columns 451, the rim portion of the bottom cup 270 contacts and is supported by rails 453, which extend generally parallel to and adjustably engage with the wire lattice members 422 of the base structure 420. Preferably, at least two wire lattice members 422 that span the perimeter wire member 421 generally perpendicular to the rails 453 are provided with downwardly extending portions 454, which serve to receive the rails 453 and serve as guides for the rails 453. The wire lattice member 422 can be biased slightly to allow for the initial insertion of the rails 453, but spring back to their original position to prevent the unintended withdrawal of the rails 453. Thus, the cup holding structure 450 is movable relative to the base structure 420 to adjust the space between the columns 451 of the cup holding structure 450 and a side panel 430 or 431 connected to the opposite side of the base structure 420 to accommodate bottles 310 of antiseptic fluid of varying size.

Rubber feet 490 are preferably affixed to downwardly extending ends 491 of the cup holding structure 450 to prevent the stand 410 from sliding on a supporting surface such as a countertop. The side panels 430, 431, are also preferably provided with downwardly extending ends 434, 435, which support the base portion 420 at an elevation slightly above the supporting surface.

It will be appreciated that other structures can be attached to and/or supported by the side panels. For example, a dental floss holder (not shown) can be removably secured to a side panel 430 using hook and loop fasteners or other engagement means. The side panel 430 can also be used to support a pill dispenser containing daily vitamins or medication.

In commercial applications, it is not necessary that the stand 410 include a side panel 431. In such an application, three side panels 430 can be used with a cup holding structure 450. It will be appreciated that the cup holding structure 450 can be omitted if disposable cups are available from another source such as a wall-mounted dispenser.

The individual components comprising the stand 410 can be assembled without the need for tools or adhesives. The components comprising the stand 410 are received by and connected to the base structure 420. The stand is lightweight, yet sturdy. It can be disassembled and stored in a minimum amount of space (e.g., for shipping). Alternatively, the side panels 430, 431 and/or the cup holding structure 450 can be permanently connected to the base structure 420, if desired.

The stand 410 is intended for placement on a countertop adjacent to a sink in a bathroom. The stand 410 may be finished in a chrome, nickel, brass or other aesthetically pleasing surface, so as to provide an attractive and highly functional oral hygiene products dispensing station. Although metal stands are presently preferred, the stand 410 could be formed of extruded plastic, which may optionally be provided with a metallic surface appearance.

Figure 9:
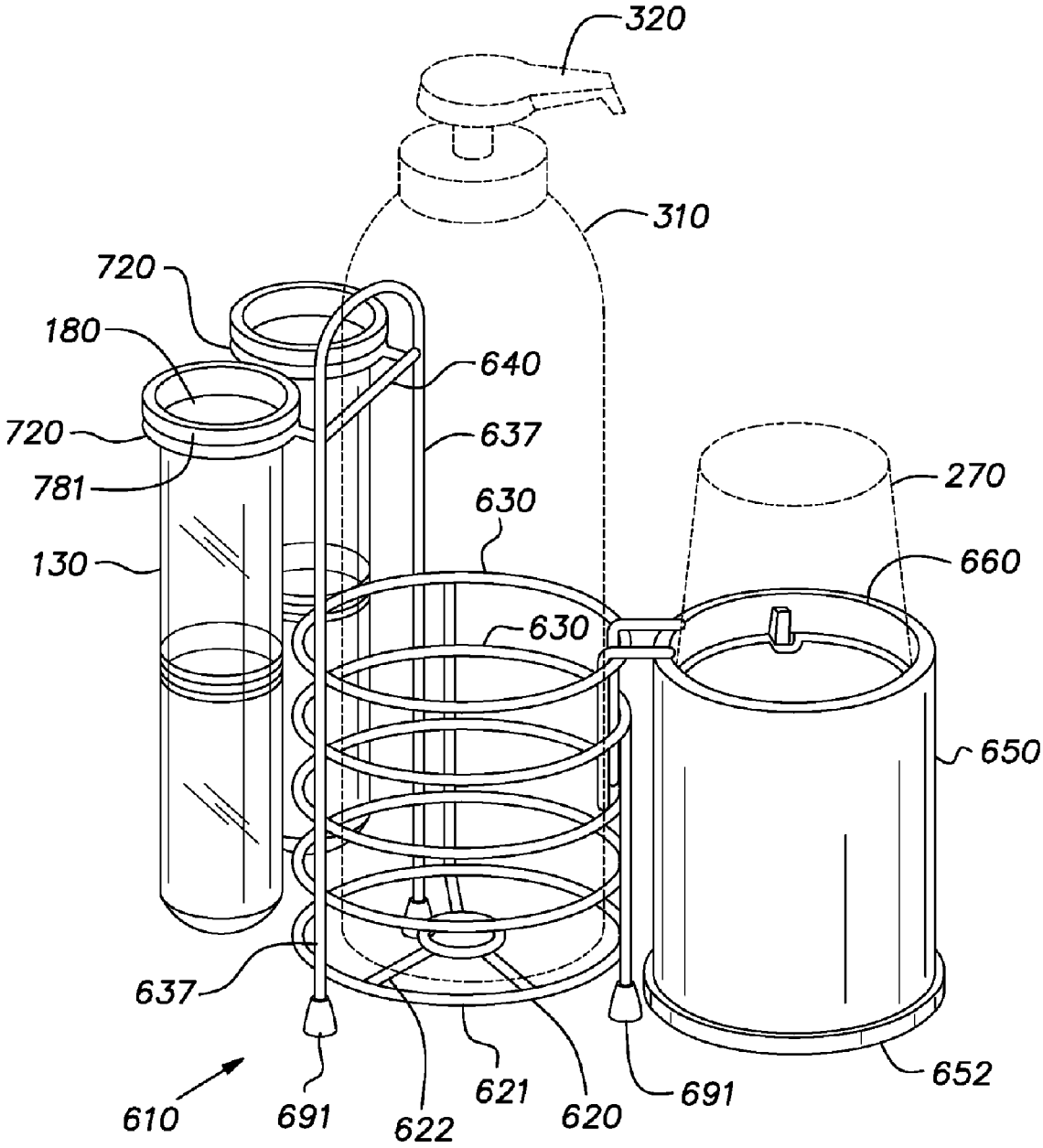
FIG. 9 is a perspective view of a third preferred embodiment of an oral hygiene products dispenser stand according to the invention.

A third preferred embodiment of an oral hygiene dispenser stand 610 according to the invention is shown in FIG. 9. In this embodiment, the oral hygiene dispenser stand 610 compromises a base structure 620 comprising a perimeter wire member 621 and a plurality of wire lattice member 622 that are connected to the perimeter wire member 621 and collectively define a substantially planar surface for supporting a bottle 310 containing about sixteen ounces or less of antiseptic fluid, which is provided with a dispensing pump 320. A plurality of uprights 637 extend upwardly from the perimeter wire member 621. One or more side panels 630 are connected to the uprights 637 to define a corral for retaining the bottle 310 on the base structure 620. In the embodiment illustrated in FIG. 9, a plurality of side panels 630 in the form of parallel spaced-apart wire rings are connected to the uprights 637 to define a substantially cylindrical corral for the bottle 310.

A shelf structure 640 extends between the uprights 637. The shelf structure 640 includes a pair of passages 720 for receiving an supporting a pair of toothbrush holders 130, such as illustrated in FIGS. 3*a*–3*c*. The diameter of each toothbrush holder 130 can be slightly larger near the upper open end 180 than the diameter of the toothbrush holder 130 near the lower closed end 190, and the passages 720 can be sized to permit passage of the lower closed end 190, but not the upper open end 180 (e.g., as shown in FIG. 4). More preferably, however, the open end 180 of each toothbrush holder is provided with a flange 781, which is larger than the diameter of the passage 720 and thus prevents the toothbrush holder 130 from passing completely through the passage 720.

A disposable cup dispenser 650 is arranged to one side of the base structure 620. The disposable cup dispenser 650 can be connected to the base structure 620, or more preferably, can be connected to one or more side panels 630. The disposable cup dispenser 650 preferably comprises a cylinder that is sized to receive an inverted stack of disposable cups 270. The disposable cup dispenser 650 thus preferably includes a lower end portion 655, which is biased in an upward directed by an internal spring (not shown). The lower end portion 655 presses upwardly against the top rim portion of the bottom-most inverted disposable cup 270 in the stack. The bottom of the rim portion of the top-most inverted disposable cup 270 in the stack presses against the bottom edge 660 of a perimeter portion of the cylinder. To obtain a disposable cup 270, a user simply pulls upwardly on the top-most disposable cup 270 in the stack, which causes the rim portion of the disposable cup 270 to pass through the perimeter portion 600 of the cylinder. The spring biases the lower end portion 655 against the inverted stack of disposable cups 270 until the bottom of the rim of the next disposable cup 270 is pressed into contact with the bottom edge 660 of the perimeter portion of the cylinder.

Rubber feet 691 can be connected to the bottom ends of the uprights 637 to prevent the stand 610 from sliding on a supporting surface such as a countertop. The base portion 652 of the disposable cup dispenser 650 can likewise be provided with a rubber friction material.

The third embodiment of the invention is particularly suitable for use by individuals or couples, and is compact enough to be used during travel. The bottles of antiseptic fluid can be sold individually, or more preferably, as a multi-bottle pack (e.g., a 6-pack). The dispensing pump can be removed from an empty bottle and installed on a new bottle removed from the multi-bottle pack. The third embodiment of the invention is preferably formed out of wire or metal, but can be formed of plastic or other materials.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. An oral hygiene products dispenser stand comprising:

a base for supporting a bottle containing an antiseptic fluid;

a truss connected to and extending upwardly from the base;

a shelf connected to and extending from the truss, wherein the shelf supports:

a disposable cup dispenser; and a plurality of toothbrush holders, wherein each toothbrush holder comprises a hollow receptacle having an open upper end through which a brush head end of a toothbrush can pass, a closed lower end, and a partition disposed between the open upper end and the closed lower end, wherein the partition divides the hollow receptacle into a lower compartment defined as that portion of the receptacle from the closed lower end to the partition and an upper compartment defined as that portion of the receptacle from the partition to the open upper end, wherein the partition prevents the brush head end of a toothbrush from entering the lower compartment, and wherein the partition includes at least one drain for allowing an antiseptic fluid to flow from the upper compartment to the lower compartment through the partition at a rate of from about 0.05 ounces per minute to about 2 ounces per minute.

2. The oral hygiene products dispenser stand according to claim 1 wherein the shelf is provided with an opening sufficiently large enough for a bottle of antiseptic fluid to pass therethrough to the base.

3. The oral hygiene products dispenser stand according to claim 2 wherein the shelf is substantially parallel to the base.

4. The oral hygiene products dispenser stand according to claim 1 wherein the lower compartment of the hollow receptacle is detachably connected to the upper compartment.

5. The oral hygiene products dispenser stand according to claim 4 wherein the upper compartment is provided with indicia indicating a maximum capacity of antiseptic fluid that can be contained in the lower compartment.

6. The oral hygiene products dispenser stand according to claim 1 further comprising a dental floss holder disposed on the disposable cup dispenser.

7. The oral hygiene products dispenser stand according to claim 1 wherein the base has a top surface for contacting and supporting the bottle of antiseptic fluid and a bottom surface that is provided with a plurality of anti-skid feet.

8. The oral hygiene products dispenser stand according to claim 1 wherein the base, truss, shelf and disposable cup dispenser are formed of plastic.

9. The oral hygiene products dispenser stand according to claim 1 wherein the hollow receptacles are formed of transparent plastic.

10. An oral hygiene products dispenser stand comprising:

a base having a top surface for contacting and supporting a bottle of antiseptic fluid and a bottom surface that is provided with a plurality of anti-skid feet;

a truss connected to and extending upwardly from the base;

a shelf connected to and extending from the truss substantially parallel to the base, wherein the shelf is provided with an opening sufficiently large enough for a bottle of antiseptic fluid to pass therethrough to the base, and wherein the shelf supports:

a plastic disposable cup dispenser having a dental floss holder disposed thereon; and a plurality of transparent toothbrush holders, wherein each toothbrush holder comprises a hollow receptacle having an open upper end through which a brush head end of a toothbrush can pass, a closed lower end, and a partition disposed between the open upper end and the closed lower end, wherein the partition divides the hollow receptacle into a lower compartment defined as that portion of the receptacle from the closed lower end to the partition and an upper compartment defined as that portion of the receptacle from the partition to the open upper end, wherein the lower compartment of the hollow receptacle is detachably connected to the upper compartment, wherein the partition prevents the brush head end of a toothbrush from entering the lower compartment, and wherein the partition includes at least one drain for allowing an antiseptic fluid to flow from the upper compartment to the lower compartment through the partition at a rate of from about 0.05 ounces per minute to about 2 ounces per minute, and the upper compartment is provided with indicia indicating a maximum capacity of antiseptic fluid that can be contained in the lower compartment.

11. An oral hygiene products dispensing station comprising:

a base;

a bottle of antiseptic fluid supported by the base, wherein the bottle includes a pump dispenser having a spout;

a truss connected to and extending upwardly from the base;

a shelf connected to and extending from the truss, wherein the shelf supports:

a disposable cup dispenser; and a plurality of toothbrush holders, wherein each toothbrush holder comprises a hollow receptacle having an open upper end through which a brush head end of a toothbrush can pass, a closed lower end, and a partition disposed between the open upper end and the closed lower end, wherein the partition divides the hollow receptacle into a lower compartment defined as that portion of the receptacle from the closed lower end to the partition and an upper compartment defined as that portion of the receptacle from the partition to the open upper end, wherein the partition prevents the brush head end of a toothbrush from entering the lower compartment, and wherein the partition includes at least one drain for allowing an antiseptic fluid to flow from the upper compartment to the lower compartment through the partition at a rate of from about 0.05 ounces per minute to about 2 ounces per minute.

12. The oral hygiene products dispensing station according to claim 11 wherein the shelf is provided with an opening sufficiently large enough for a bottle of antiseptic fluid to pass therethrough to the base.

13. The oral hygiene products dispenser station according to claim 12 wherein the shelf is substantially parallel to the base, and wherein at least one of the toothbrush holders is supported by the shelf beneath the spout.

14. The oral hygiene products dispenser station according to claim 11 wherein the lower compartment of the hollow receptacle is detachably connected to the upper compartment.

15. The oral hygiene products dispenser station according to claim 14 wherein the upper compartment is provided with indicia indicating a maximum capacity of antiseptic fluid that can be contained in the lower compartment.

16. The oral hygiene products dispenser station according to claim 11 further comprising a dental floss holder disposed on the disposable cup dispenser.

17. The oral hygiene products dispenser station according to claim 11 wherein the base has a top surface for contacting and supporting the bottle of antiseptic fluid and a bottom surface that is provided with a plurality of anti-skid feet.

18. The oral hygiene products dispenser station according to claim 11 wherein the base, truss, shelf and disposable cup dispenser are formed of plastic.

19. The oral hygiene products dispenser station according to claim 11 wherein the hollow receptacles are formed of transparent plastic.

20. An oral hygiene products dispenser station comprising:

a base having a top surface and a bottom surface, wherein the bottom surface is provided with a plurality of anti-skid feet;

a bottle of antiseptic fluid contacting and supported by the base, wherein the bottle includes a pump dispenser having a spout;

a truss connected to and extending upwardly from the base;

a shelf connected to and extending from the truss substantially parallel to the base, wherein the shelf is provided with an opening sufficiently large enough for a bottle of antiseptic fluid to pass therethrough to the base, and wherein the shelf supports:

a plastic disposable cup dispenser having a dental floss holder disposed thereon; and a plurality of transparent toothbrush holders, wherein at least one of the plurality of toothbrush holders is supported by the shelf beneath the spout, and wherein each toothbrush holder comprises a hollow receptacle having an open upper end through which a brush head end of a toothbrush can pass, a closed lower end, and a partition disposed between the open upper end and the closed lower end, wherein the partition divides the hollow receptacle into a lower compartment defined as that portion of the receptacle from the closed lower end to the partition and an upper compartment defined as that portion of the receptacle from the partition to the open upper end, wherein the lower compartment of the hollow receptacle is detachably connected to the upper compartment, wherein the partition prevents the brush head end of a toothbrush from entering the lower compartment, and wherein the partition includes at least one drain for allowing an antiseptic fluid to flow from the upper compartment to the lower compartment through the partition at a rate of from about 0.05 ounces per minute to about 2 ounces per minute, and the upper compartment is provided with indicia indicating a maximum capacity of antiseptic fluid that can be contained in the lower compartment.

21. An oral hygiene products dispenser stand comprising:

a base structure comprising a perimeter wire member and a plurality of wire lattice members having ends connected to the perimeter wire member to form a generally planar support for a bottle;

at least one side panel connected to the base structure, the side panel comprising an upright that supports a shelf structure provided with at least one passage;

a detachable toothbrush holder configured to partially pass through the passage and thereby be supported by the shelf structure, wherein the toothbrush holder comprises a hollow receptacle having an open upper end through which a brush head end of a toothbrush can pass, a closed lower end, and a partition disposed between the open upper end and the closed lower end, wherein the partition divides the hollow receptacle into a lower compartment defined as that portion of the receptacle from the closed lower end to the partition and an upper compartment defined as that portion of the receptacle from the partition to the open upper end, wherein the partition prevents the brush head end of a toothbrush from entering the lower compartment, and wherein the partition includes at least one drain for allowing an antiseptic fluid to flow from the upper compartment to the lower compartment through the partition at a rate of from about 0.05 ounces per minute to about 2 ounces per minute; and a cup holding structure connected to the base structure, the cup holding structure comprising a plurality of columns define a receptacle for receiving a stack of disposable cups.

22. The oral hygiene products dispenser stand according to claim 21 wherein the base structure, side panel and the cup holding structure are formed of metal, and the toothbrush holder is made of plastic.

23. The oral hygiene products dispenser stand according to claim 21, wherein the side panel is releasably connected to the base structure.

24. The oral hygiene products dispenser stand according to claim 23, wherein the side panel includes at least two ends configured to be releasably received in corresponding receiving tubes connected to the base structure.

25. The oral hygiene products dispenser stand according to claim 21, wherein the cup holding structure further comprises a plurality of anti-skid feet.

* * * * *